US005105747A

United States Patent [19]

Khinkis et al.

[11] Patent Number: 5,105,747

[45] Date of Patent: * Apr. 21, 1992

[54] PROCESS AND APPARATUS FOR REDUCING POLLUTANT EMISSIONS IN FLUE GASES

[75] Inventors: Mark J. Khinkis, Morton Grove; Jitendra G. Patel, Bolingbrook; Amirali G. Rehmat, Westmont, all of Ill.

[73] Assignee: Institute of Gas Technology, Chicago, Ill.

[ * ] Notice: The portion of the term of this patent subsequent to May 28, 2008 has been disclaimed.

[21] Appl. No.: 699,164

[22] Filed: May 13, 1991

Related U.S. Application Data

[63] Continuation-in-part of Ser. No. 486,065, Feb. 28, 1990, Pat. No. 5,020,456.

[51] Int. Cl.[5] ..... F23J 11/00

[52] U.S. Cl. ..... 110/345; 110/244; 110/245

[58] Field of Search ..... 110/245, 345, 244

[56] References Cited

U.S. PATENT DOCUMENTS

| | | | |
|---|---|---|---|
| 3,781,162 | 12/1973 | Rudd et al. . | |
| 3,938,449 | 2/1976 | Frisz et al. . | |
| 3,955,909 | 5/1976 | Craig et al. . | |
| 4,013,399 | 3/1977 | Craig et al. . | |
| 4,050,877 | 9/1977 | Craig et al. . | |
| 4,336,469 | 6/1982 | Wysk . | |
| 4,538,529 | 9/1985 | Temelli . | |
| 4,589,353 | 5/1986 | Bauver, II . | |
| 4,624,192 | 11/1986 | Mansfield . | |
| 4,628,833 | 12/1986 | O'Hagan et al. . | |
| 4,646,661 | 3/1987 | Roos et al. . | |
| 4,651,653 | 3/1987 | Anderson et al. | 110/245 |
| 4,672,900 | 6/1987 | Santalla et al. . | |
| 4,779,545 | 10/1988 | Breen et al. . | |
| 4,815,418 | 3/1989 | Maeda et al. | 110/245 |
| 4,913,068 | 4/1980 | Brannstrom | 110/245 |
| 5,020,456 | 6/1991 | Khinkis et al. | 110/345 |

*Primary Examiner*—Henry C. Yuen
*Attorney, Agent, or Firm*—Speckman & Pauley

[57] ABSTRACT

A combustion process and apparatus for simultaneously reducing nitrogen oxides, sulfur oxides and hydrogen chloride in a high temperature furnace. A combustible material is introduced and combusted within the furnace, forming a primary combustion zone. Combustion air, sorbent and a first portion of hydrocarbon fuel are mixed and combusted within a calciner to form a product gas/calcined sorbent mixture. The product gas/calcined sorbent mixture and a remaining portion of fuel are injected into the furnace, forming an oxygen deficient secondary combustion downstream of the primary combustion zone. Overfire air is injected into the furnace, forming an oxidizing tertiary combustion zone downstream of the oxygen deficient secondary combustion zone.

29 Claims, 2 Drawing Sheets

PROCESS AND APPARATUS FOR REDUCING POLLUTANT EMISSIONS IN FLUE GASES

CROSS REFERENCE TO RELATED APPLICATION

This application is a continuation-in-part of copending U.S. patent application Ser. No. 07/486,065 filed Feb. 28, 1990, U.S. Pat. No. 5,020,456.

BACKGROUND OF THE INVENTION

1. Field of the Invention

This invention relates to a process and apparatus for reducing pollutant emissions including $NO_x$, $SO_x$, HCl, CO, total hydrocarbons (THC) and chlorinated hydrocarbons (CNC) in the flue gases derived from the combustion of combustible material, including municipal solid waste (MSW) and refuse derived fuel (RDF), in a high temperature furnace.

2. Description of the Prior Art

Most of the existing processes and apparatuses for combustion of combustible materials, and in particular, waste, such as municipal solid waste (MSW) or refuse derived fuel (RDF), include a combustion chamber equipped with a sloped or horizontal stoker grate that reciprocates or travels to move the combustible material from the combustible material inlet side of the combustion chamber to the ash removal side of the combustion chamber. A portion of the combustion air, generally equivalent to 1.0 to 1.3 of the combustible material stoichiometric equivalent, is supplied under the stoker grate. Such combustion air, typically called undergrate air, is distributed through the stoker grate to dry and combust the material present on the stoker grate. The combustible material is first dried on the drying portion or drying grate of the stoker grate, then combusted on the combustion portion or combustion grate of the stoker grate. Residual material from the combustion grate, primarily ash, is decarbonized or further combusted on the burnout portion or burnout grate of the stoker grate. The bottom ash is then removed through an ash pit. To assure carbon burnout, a high level of excess air above the stoichiometric level required for carbon burnout is maintained at the burnout grate. The combustion products from the stoker grate generally include carbon dioxide ($CO_2$), water vapor ($H_2O$), nitrogen oxides ($NO_2$), sulfur oxides ($SO_x$), hydrogen chloride (HCl), carbon monoxide (CO), total hydrocarbons (THC) and chlorinated hydrocarbons (CNC). For environmental reasons, it is necessary to control the amount of emissions, and in particular, $NO_x$, $SO_x$, HCl, CO, THC and CHC, from this process released with the flue gases into the atmosphere. While CO and THC can be readily controlled by the addition of overfire air introduced above the stoker grate and mixed with products of combustion evolved from the stoker grate, reduction of $NO_x$, $SO_x$, HCl and CHC emissions requires a different approach. Indeed, the addition of overfire air which results in an excess air level downstream of the point of injection of the overfire air in the range of 60% to 100% of the stoichiometric requirement for complete combustion of the combustible material contributes to the formation of significant quantities of fuel $NO_x$. Based on measurements by the inventors, typical mass burn operations result in about 30% of the total amount of $NO_x$ derived from the process generated on the stoker grate and about 70% at and downstream of the overfire air injection point.

In most cases, a boiler to recover heat generated by the combustion of the combustible material is an integral part of the combustion apparatus. In some cases, a portion of the flue gases from downstream of the boiler are recirculated back into the combustion chamber to reduce oxygen concentration and lower combustion temperatures, thereby inhibiting $NO_x$ formation. However, flue gas recirculation (FGR) generally results in higher concentrations of CO and THC within the flue gases, a significant disadvantage of using FGR as a technique for reducing $NO_x$ formation.

Known in-furnace processes for combined reduction of $NO_x$, $SO_x$, HCl, CO, THC and CHC require relatively long residence times for the products of combustion within the combustion chamber and generally provide no more than about 40%-50% $SO_x$ reduction and only up to 60% HCl reduction in the flue gases.

One known process for combined, but non-simultaneous, $NO_x$, $SO_x$, HCl, CO, THC and CHC reduction in flue gases from a boiler includes injecting hydrocarbon fuel into an area of the combustion chamber above the primary combustion zone and mixing the hydrocarbon fuel with the products of combustion from the primary combustion zone, forming a reducing zone which inhibits the formation of $NO_x$ due to the lack of oxygen and provides decomposition of fixed nitrogen species (FNS) such as $NH_3$ and HCN within the zone. Overfire air is then injected into an oxidizing zone above the reducing zone to ensure complete combustion of combustibles in the combustion products exiting the reducing zone and entering the oxidizing zone. Finally, a sorbent, such as limestone or dolomite, is injected into still another zone above the oxidizing zone and mixed with the products of combustion from the oxidizing zone, thereby reducing the $SO_x$ and HCl content of the combustion products leaving this latter zone. Because of the non-simultaneous reduction of $NO_x$, $SO_x$, HCl, CO, THC and CHC in this process, longer residence times for combustion products within the various zones are required, requiring, in turn, generally larger combustion apparatuses.

Several techniques for reducing $NO_x$ emissions from combustion processes are taught in the prior art. U.S. Pat. No. 3,781,162 teaches an apparatus for mixing recirculated flue gases with combustion air prior to injection into a furnace to reduce the formation of $NO_x$ caused by the combustion of fuel.

U.S. Pat. No. 3,938,449 teaches the use of a rotary kiln for waste disposal in which the waste materials are combusted under stoichiometric conditions at temperatures below 2200° F. to prevent the formation of $NO_x$. The hot gases from the kiln are passed through a steam generator after which they are used to preheat and dehydrate the waste material prior to introduction into the kiln. As a final step, the gaseous output from the kiln is sent to a scrubber and then to evaporation ponds where solid material from the gases is deposited.

U.S. Pat. No. 4,336,469 teaches a method for operating a magnetohydrodynamic power plant in which fossil fuel is burned substoichiometrically in a combustor to produce a high temperature, fuel-rich product gas. A reducing agent, such as natural gas, is injected into the fuel-rich product gas as it passes from the combustor to a dwell chamber. The resulting mixture is retained in the dwell chamber for approximately one second, thereby permitting the reducing agent to decompose a portion of the $NO_x$ formed in the combustor. The fuel-rich product gas then passes through an afterburner wherein combustion is completed and any excess reducing agent is consumed.

U.S. Pat. No. 4,672,900 teaches a tangentially-fired furnace having injection ports for injecting secondary combustion air above the fireball in the combustion chamber to control $NO_x$ formation and eliminate flue gas swirl, thereby equalizing the temperature throughout the flue gases as they exit the combustion chamber and enter the economizer section of the furnace.

Related U.S. Pat. Nos. 4,013,399, 4,050,877 and 3,955,909 teach the reduction of gaseous pollutants in flue gases using two-stage combustion. Fuel is burned in a combustion chamber under substoichiometric conditions and at temperatures below that at which significant $NO_x$ would be produced. The combustion gases are passed through a secondary combustion zone into which additional air has been injected through a plurality of foraminous tubes for completion of the combustion process. The temperature of the secondary zone is also maintained below the temperature at which significant amounts of $NO_x$ would be formed.

U.S. Pat. No. 4,589,353 teaches a furnace for burning wood chips or other cellulose fuel in which the cross-sectional area of the furnace increases with increasing furnace height to reduce the velocity of upwardly flowing combustion products. As a result, any partially combusted particles initially picked up by the upwardly flowing combustion gases reach a height where the gas velocity equals the particle terminal velocity, at which point the remain suspended until they have been further combusted and reduced in size to be carried out of the furnace by lower velocity gases. Air to support the combustion is introduced through openings beneath grates supporting the combustible material. Secondary air is injected into the furnace above the grates creating an oxidizing secondary combustion zone.

U.S. Pat. No. 4,538,529 teaches a nozzle box for blowing secondary air streams at high velocity into a stream of flue gas emanating from the combustion of garbage on a combustion grate creating a secondary combustion zone in which volatile components (fumes) generated from the combustion of the garbage are completely combusted.

U.S. Pat. Nos. 4,624,192, 4,646,661 and 4,628,833 teach the use of vitiated air in stoker-type furnaces.

Finally, U.S. Pat. No. 4,779,545 discloses a method and apparatus for reducing $NO_x$ emissions from furnace flue gases by injecting pulses of natural gas or other fluid fuel which has little or no fixed nitrogen into the upper portion of the furnace where it mixes with the $NO_x$-laden flue gases from the combustion of coal in the lower portion of the furnace, forming ammonia-like compounds and nitrogen gas. The ammonia-like compounds react with additional amounts of $NO_x$ in the flue gas to form nitrogen gas, water vapor and carbon dioxide, resulting in the reduction of $NO_x$ in the flue gases.

Of the prior art discussed hereinabove, none discloses or suggests a process for the simultaneous reduction of $NO_x$, $SO_x$, HCl, CO, THC and CHC in the flue gases from the combustion of combustible material, such as municipal solid waste and refuse derived fuel, in a combustion chamber.

SUMMARY OF THE INVENTION

It is an object of this invention to provide a process and apparatus for simultaneously reducing $NO_x$, $SO_x$, HCl, CO, THC and CHC emissions in flue gases from the combustion of combustible material in the combustion chamber of a furnace, in particular, a high temperature furnace.

It is another object of this invention to simultaneously reduce $NO_x$, $SO_x$, HCl, CO, THC and CHC emissions in flue gases from the combustion of combustible material in the combustion chamber of a furnace while increasing the overall efficiency of the thermal operation of the furnace.

It is still another object of this invention to provide multiple combustion zones for reducing $NO_x$, $SO_x$, HCl, CO, THC and CHC in the flue gases including a primary combustion zone in which combustible material is burned, a reducing secondary combustion zone in which $NO_x$, $SO_x$, HCl and FNS in the combustion products from the primary combustion zone are simultaneously reduced, and an oxidizing tertiary combustion zone in which additional reduction of $SO_x$ and HCl occurs and any remaining combustible in the combustion products from the reducing secondary combustion zone are combusted without forming additional $NO_x$.

These objects are accomplished in accordance with one embodiment of this invention in which combustible material is injected into a plurality of walls which define a combustion chamber of a stoker-type furnace having at least one drying grate, at least one combustion grate and at least one burnout grate. At least one ash pit is located downstream of the burnout grate, within the combustion chamber. At the exhaust end of the combustion chamber is a boiler or other heat recovery device in which heat in the combustion products is used for generating steam or providing thermal energy for some other process.

At least one combustible material inlet is located in at least one wall of the combustion chamber in a position such that the combustible material is introduced into the combustion chamber onto the drying grate. At least one conduit is in communication with a primary combustion air or undergrate air source and a space beneath the grates. Primary combustion air injected into the combustion chamber from beneath the grates is used to 1) dry the combustible material on the drying grate, 2) combust the dried combustible material which has been moved by combustible material advancement means from the drying grate to the combustion grate to form a primary combustion zone immediately above the combustion grate, and 3) burn out any combustible material remaining in the ash from the combustion grate which has been moved by combustible material advancement means onto the burnout grate. Ash from the burnout grate is deposited into the ash pit.

In a preferred embodiment of this invention, through an opening in a wall of the combustion chamber, a mixture of combustion products from the calcination of a sorbent, calcined sorbent and natural gas, and/or recirculated flue gases from the exhaust of the boiler or heat recovery section of the furnace is introduced into the combustion chamber directly above the primary combustion zone, forming an oxygen deficient secondary combustion zone. In another embodiment of this invention, non-calcined absorbent is introduced into the combustion chamber directly above the primary combustion zone, forming an oxygen deficient secondary combustion zone. Other fluids which may be introduced into the oxygen deficient secondary combustion zone include water, steam, industrial grade nitrogen, $N_2$, and oxygen, $O_2$, and air. Oxygen deficient in reference to the secondary combustion zone for purposes of this disclosure means insufficient oxygen for oxidizing nitrogen and nitrogen-containing compounds to $NO_x$ within the secondary combustion zone.

Calcination of the sorbent prior to its introduction into the combustion chamber reduces the time required for conversion of $SO_x$ and Cl in the oxygen deficient secondary combustion zone compared to the time required when non-calcined sorbent is introduced into the combustion chamber. This is true because when non-calcined sorbent is introduced into the combustion chamber, calcination of the sorbent occurs in the combustion chamber before conversion of $SO_x$ and Cl occurs thus adding to the residence time of the combustion products in the oxygen deficient secondary combustion zone. In the oxygen deficient secondary combustion zone, $SO_x$ and HCl produced in the primary combustion zone are significantly reduced and fixed nitrogen species (FNS) ar mostly decomposed.

In one embodiment of this invention, industrial grade nitrogen is used to aspirate flue gases from the exhaust of the boiler or heat recovery section of the furnace and recirculate them into the oxygen deficient secondary combustion zone.

Through still another opening in a wall of the combustion chamber, overfire air comprising at least one of vitiated air withdrawn from above the burnout grate in the combustion chamber and fresh air is introduced into the combustion chamber directly above the oxygen deficient secondary combustion zone, forming an oxidizing tertiary combustion zone. Industrial grade oxygen may also be a component of the overfire air. In accordance with one embodiment of this invention, industrial grade oxygen is used to aspirate vitiated air from above the burnout grate into the tertiary combustion zone. Combustion of carbon monoxide, hydrogen, unburned hydrocarbons and other combustibles entering this zone from the oxygen deficient secondary combustion zone is completed in this oxidizing tertiary combustion zone. Also occurring in this zone is further reduction of $SO_x$ and HCl in the combustion products. Using the process and apparatus of this invention, $NO_x$ in the flue gases is reduced by about 50% to about 70%, $SO_x$ in the flue gases is reduced by about 80% to about 95% and HCl is reduced by about 95% to about 99%, while CO and THC are maintained at levels below about 30 ppm and 3 ppm, respectively. In addition, CHC formation in the boiler is prevented, reducing CHC concentrations in the flue gases by about 95% to about 99%.

Sorbent introduced into the combustion chamber should have a particle size such that it is entrained by the combustion products in the combustion chamber and transported through the combustion chamber, all convective passages of the downstream boiler as well as through the flue gas duct connecting the boiler exhaust and any particulate removal device attached thereto There should be virtually no sorbent deposition on the stoker grate. Any residual sorbent, spent or unspent, on the stoker grate is removed with the bottom ash.

In a preferred embodiment of this invention, sorbent introduced into the combustion chamber has a mean particle size preferably in a range of about 1 μm to about 10 m. The amount of sorbent introduced into the combustion chamber should provide a ratio in a range of about 1:1 to about 4:1 of Ca to sulfur and Ca to chloride.

In a preferred embodiment of this invention, fluids injected into the oxygen deficient secondary and oxidizing tertiary combustion zones are injected through nozzles positioned in a wall of the combustion chamber such that the fluids are injected into the combustion chamber tangentially with respect to the combustion chamber walls. In yet another preferred embodiment of the invention, the fluids are injected tangentially or radially into the combustion chamber at an angle with respect to the horizontal.

In a preferred embodiment of this invention, calcination of the sorbent is carried out in a calciner separate and apart from the furnace. Combustion air and a first portion of hydrocarbon fuel are introduced into the calciner containing sorbent and ignited, forming a combustion products/calcined sorbent mixture. The resulting combustion products/calcined sorbent mixture and a remaining portion of hydrocarbon fuel are injected into the combustion chamber, forming an oxygen deficient secondary combustion zone in which $SO_x$, HCl and FNS in the combustion products from the primary combustion zone are reduced. The calciner can be any conventional calciner device suitable for the process of this invention. The preferred calciner is of a cyclone type into which the combustion air and hydrocarbon fuel are injected tangentially to the calciner walls causing the products of combustion to swirl in a cyclone-like manner within the calciner. The sorbent is calcined preferably in the temperature range of about 1600° F. to about 2200° F.

In one embodiment of this invention, the combustion products/calcined sorbent mixture exiting the calciner is mixed with a remaining portion of hydrocarbon fuel and injected into the combustion chamber forming the oxygen deficient secondary combustion zone. Temperature of the oxygen deficient secondary combustion zone is preferably about 1600° F. to about 2400° F.

In another embodiment of this invention, the product gas/calcined sorbent and a remaining portion of hydrocarbon fuel are injected separately into the combustion chamber in which they mix, forming the oxygen deficient secondary combustion zone. In still another embodiment of this invention, recirculated flue gases from the exhaust of the boiler section of the furnace are injected into the oxygen deficient secondary combustion zone together with the combustion products/calcined sorbent mixture and a remaining portion of hydrocarbon fuel.

In one embodiment of this invention, mounted within an opening formed in a combustion chamber wall, preferably above the burnout grate, is a fan, blower, compressor or other type of air moving or compressing apparatus inlet through which vitiated air from above the burnout grate is withdrawn, compressed and reinjected through a nozzle into the combustion chamber above the reducing secondary combustion zone, forming an oxidizing tertiary combustion zone. In another embodiment of the invention, the vitiated air is mixed with fresh air and then injected into the combustion chamber. In still another embodiment, only fresh air is injected into the combustion chamber above the oxygen deficient secondary combustion zone, forming an oxidizing tertiary combustion zone. In still another embodiment of this invention, industrial grade oxygen is mixed with vitiated air and then injected into the combustion chamber.

The amount of overfire air, that is, vitiated air and/or fresh air and/or industrial grade oxygen, injected into the combustion chamber to form an oxidizing tertiary combustion zone is an amount sufficient to provide about 5% to about 50% excess air within the oxidizing tertiary combustion zone necessary for the complete combustion of carbon monoxide, hydrogen, hydrocarbons and other combustibles entering this zone from the reducing secondary combustion zone.

These and other objects and features of the invention will be more readily understood and appreciated from the description and drawings contained herein.

DESCRIPTION OF THE PREFERRED EMBODIMENTS

As used in the specification and claims, $NO_x$ is oxides of nitrogen or nitrogen oxides, such as NO, $NO_2$, and $N_2O$; $SO_x$ is oxides of sulfur or sulfur oxides, such as $SO_2$ and $SO_3$; THC is total hydrocarbons; CNC is chlorinated hydrocarbons; FNS is fixed nitrogen species, such as $NH_3$ and HCN and HCl is hydrogen chloride. The primary combustion zone is the zone in which combustion of the combustible material occurs, in the vicinity immediately above the combustion grate. The secondary combustion zone is the volume of the combustion chamber downstream of the primary combustion zone into which products of combustion from the primary combustion zone flow. The tertiary combustion zone is the volume of the combustion chamber downstream of the secondary combustion zone into which derivative combustion products from the secondary combustion zone flow. The term "combustible material" as used in this specification and in the claims means any suitable material which can be burned. However, without intending to limit its scope in any manner, "combustible material" used in the process and apparatus of this invention will typically be municipal solid waste (MSW), refuse derived fuel (RDF), and/or other comparable solid waste. It is conceivable that waste may also have glass, metal, paper and/or plastic material removed from the composition, such as in the case of RDF, and still be used as combustible material in the furnace of this invention. Finally, the term "oxygen deficient" as used throughout this specification and in the claims means insufficient oxygen to promote the formation of $NO_x$ in the presence of nitrogen or nitrogen-containing compounds.

Figure 1:
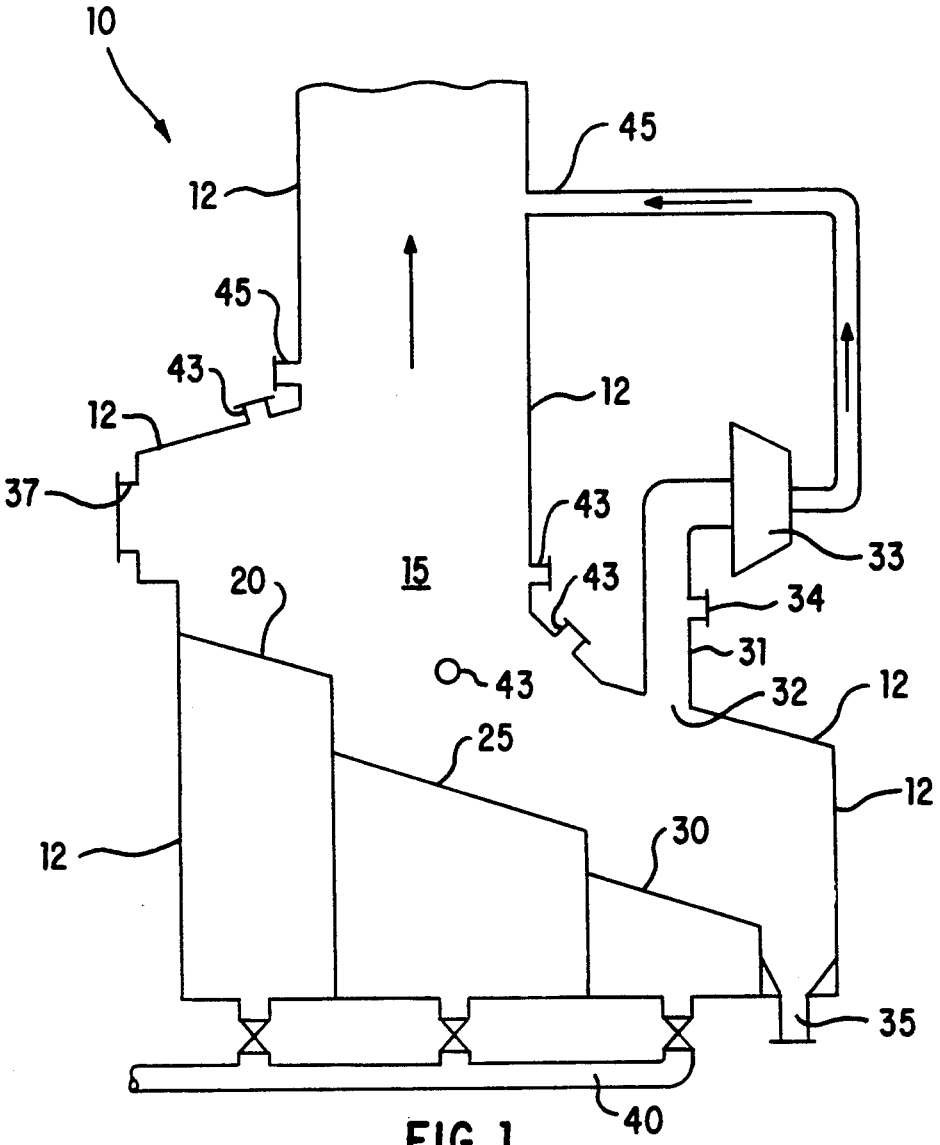
FIG. 1 shows a diagrammatic cross-sectional front view of a furnace for combustion of combustible material according to one embodiment of this invention.

The apparatus for combustion of combustible material in accordance with one embodiment of this invention, furnace 10, is shown in a diagrammatic cross-sectional front view in FIG. 1. A plurality of walls 12 define combustion chamber 15. A stoker grate positioned within combustion chamber 15, preferably in a lower portion thereof, comprises at least one drying grate portion 20, at least one combustion grate portion 25, and at least one burnout grate portion 30. At least one ash pit outlet 35 is located within combustion chamber 15, positioned to receive ash from burnout grate portion 30. At least one combustible material inlet means 37 is positioned in wall 12 above the grate such that the combustible material enters combustion chamber 15 and flows onto drying grate portion 20. The combustible material is advanced by combustible material advancement means from drying grate portion 20, over combustion grate portion 25, over burnout grate portion 30, and into ash pit outlet 35.

Undergrate air supply means comprises at least one undergate air conduit 40 in communication with an undergate air source and a space beneath at least one of drying grate portion 20, combustion grate portion 25, and burnout grate portion 30. Undergrate air conduit 40 is used to supply undergrate air beneath and then through the grate. An undergrate air source and at least one space beneath the stoker are in communication with undergrate air conduit 40 and are also used to provide undergrate air beneath and then through the grate. Undergrate air is the primary source of air for combustion of combustible material in combustion chamber 15. Combustion of the combustible material occurs in combustion chamber 15 primarily in the vicinity immediately above combustion grate portion 25, forming a primary combustion zone.

At least one sorbent inlet means 44 is secured to wall 12 and in communication with combustion chamber 15. Sorbent inlet means can inlclude at least one sorbent inlet nozzle 43 secured to wall 12 and in communication with combustion chamber 15. A mixture of combustion products and calcined sorbent from calciner 50 shown in FIG. 4, hydrocarbon fuel, preferably natural gas, and optionally, flue gases recirculated from the boiler section of the furnace (not shown) are injected into combustion chamber 15 through sorbent inlet nozzle 43 creating an oxygen deficient secondary combustion zone immediately downstream of the primary combustion zone into which combustion products from the primary cobustion zone flow. In another embodiment of this invention, sorbent, preferably limestone and/or dolomite, which has not been calcined is injected into combustion chamber 15 through sorbent inlet nozzle 43, ostensibly for the purpose of enhancing mixing in the resulting oxygen deficient secondary combustion zone. The temperature of the oxygen deficient secondary combustion zone preferably is between about 1600° F. and about 2400° F. and the oxygen concentration within the oxygen deficient secondary combustion zone is preferably between about 0.6 and 1.2 of the stoichiometric requirement for complete combustion of combustibles within the secondary combustion zone. At least one overfire air means 60 is secured to wall 12 and in communication with combustion chamber 15. Overfire air means can include an overfire air nozzle 45 secured to wall 12 and in communication with combustion chamber 15. Each overfire air nozzle 45 is secured to wall 12 in such a position that a fluid, preferably vitiated air withdrawn from above burnout grate portion 30, is injected into combustion chamber 15 downstream of the oxygen deficient secondary combustion zone. In a preferred embodiment of this invention, each overfire air nozzle 45 and each sorbent inlet nozzle 43 is either positioned or has internal mechanical components known in the art for tangentially o radially injecting their respective fluids into combustion chamber 15. It is apparent that internal baffles, internal or external nozzles, or the like, can be used to tangentially or radially direct the fluid into combustion chamber 15. Thus fluid swirl which enhances mixing Can be accomplished in combustion chamber 15 having any type of cross section, even a rectangular cross section as shown in FIG. 3.

Figure 2:
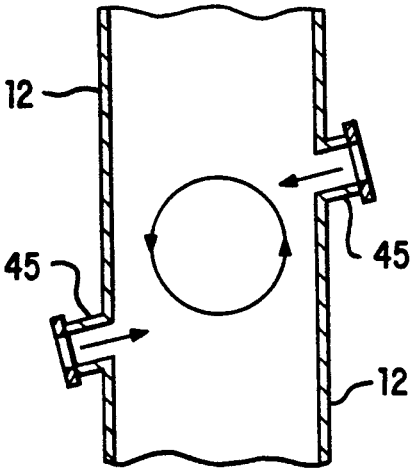
FIG. 2 shows a cross-sectional side view of a upper wall of the combustion chamber having nozzles secured at an angle with respect to the horizontal according to one embodiment of this invention.
Figure 3:
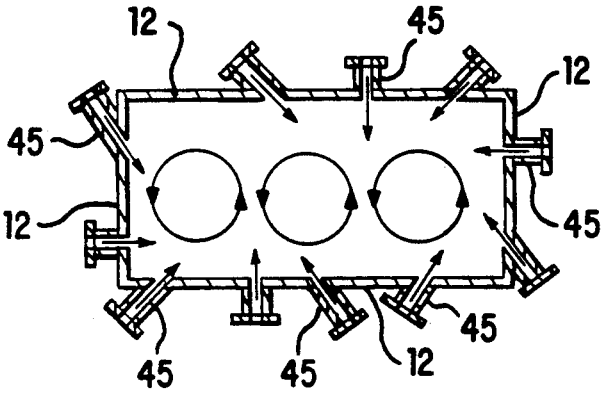
FIG. 3 shows a cross-sectional top view of the upper walls of the combustion chamber having secured nozzles that can be used to tangentially inject a fluid according to one embodiment of this invention.

Referring to FIG. 3, overfire air nozzle 45 can be positioned at angles relative to wall 12 such that at least one swirl, preferably multiple swirls, are formed within combustion chamber 15. It is apparent that the fluid can be injected into combustion chamber 15 at an angle with respect to the horizontal by positioning overfire air nozzle 45 at an angle with respect to the horizontal, as shown in FIG. 2.

In one embodiment of this invention, exhaust means for exhausting vitiated air from above burnout grate portion 30 comprises at least one induced draft fan 33 mounted within exhaust opening 32, preferably above burnout grate portion 30. Induced draft fan 33 is used to exhaust vitiated air from above burnout grate portion 30, within combustion chamber 15. In another embodiment of this invention, induced draft fan 33 and a discharge nozzle are used to inject vitiated air into combustion chamber 15, downstream of the oxygen deficient secondary combustion zone. In a preferred embodiment, the vitiated air is mixed with fresh air injected through air inlet means 34 into vitiated air duct 31 and then the mixture is injected into combustion chamber 15 through overfire air nozzle 45, forming an oxidizing tertiary combustion zone downstream of the oxygen deficient secondary combustion zone. The temperature of the oxidizing tertiary combustion zone preferably is between about 1600° F. and about 2400° F. The amount of vitiated air and/or fresh air injected through overfire air nozzle 45 is sufficient to provide preferably between about 5% and about 50% excess air within the oxidizing tertiary combustion zone.

Exhaust opening 32 can be positioned at any suitable location within wall 12, above burnout grate portion 30, preferably within the top section of wall 12, as shown in FIG. 1. Vitiated air duct 31 is sealably secured to wall 12 around exhaust opening 32. It is apparent that induced draft fan 33 can be a blower, a suction nozzle of a compressor, or any other type of suitable air compressing device or blower means.

Figure 4:
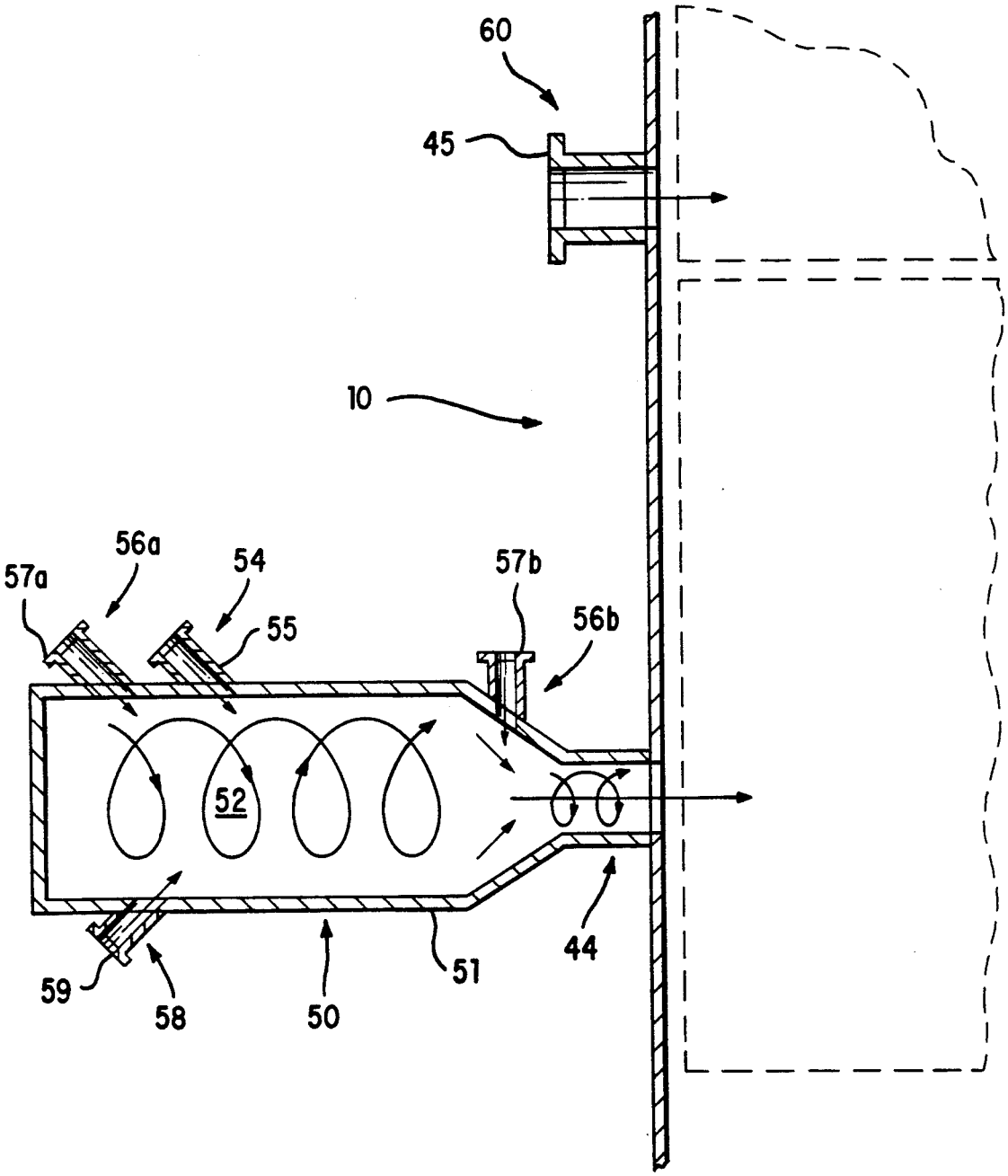
FIG. 4 shows a cross-sectional view of a furnace wall section showing the calciner and an overfire air inlet according to one embodiment of this invention.

FIG. 4 shows a cross sectional view of calciner 50 according to one embodiment of this invention. A first portion of hydrocarbon fuel, preferably natural gas, is mixed with combustion air and combusted in calciner 50 into which a sorbent, preferably limestone or dolomite, has been introduced. The first portion of hydrocarbon fuel is introduced into calciner 50 through hydrocarbon fuel inlet means **56*a*. Hydrocarbon fuel inlet means can include at least one hydrocarbon fuel inlet nozzle 57*a* secured to calciner wall 51 and in communication with calciner combustion chamber 52. It should be noted that, although this invention is described throughout the specification and claims as using hydrocarbon fuel, in addition to the preferred hydrocarbon fuel being natural gas, other hydrocarbon fuels, such as methanol, No. 2 fuel oil, kerosene, diesel fuel, liquid natural gas and liquid propane gas, are also suitable for use in this invention. Combustion air is introduced into calciner 50 through combustion air inlet means 54. Combustion air inlet means 54 can include at least one combustion air nozzle 55 secured to calciner wall 51 and in communication with calciner combustion chamber 52. Sorbent is introduced into calciner 50 through calciner sorbent inlet means 58. Calciner sorbent inlet means can include at least one calciner sorbent inlet nozzle 59 secured to calciner wall 51 and in communication with calciner combustion chamber 52. The sorbent is preferably in a ground form so that it can be carried within a fluid and thus injected into calciner 50. The resulting combustion products/calcined sorbent mixture is mixed with a remaining portion of hydrocarbon fuel which, in accordance with one embodiment of this invention, is introduced through remaining hydrocarbon fuel mixing means 56*b* and, optionally, flue gases from the boiler section of the furnace, and injected into combustion chamber 15 through sorbent inlet nozzle 43, forming an oxygen deficient secondary combustion zone within combustion chamber 15. Remaining hydrocarbon fuel mixing means can include remaining hydrocarbon fuel mixing nozzle 57*b* secured to calciner wall 51, in communication with and located near the exit to calciner combustion chamber 52**. It is preferred that the amount of oxygen in the oxygen deficient secondary combustion zone be between about 0.6 and 1.2 of the stoichiometric requirement for complete combustion of combustibles in the zone.

In accordance with another embodiment of this invention, each of the combustion products/calcined sorbent mixture, the remaining portion of hydrocarbon fuel and the flue gases recirculated from the boiler section of the furnace is injected independently of each other into combustion chamber 15 and mixed therein to form an oxygen deficient secondary combustion zone.

In one preferred embodiment of this invention, the first portion of hydrocarbon fuel injected into calciner 50 comprises between about 1% to about 30% of the total amount of hydrocarbon fuel injected into combustion chamber 15 through sorbent inlet nozzle 43 to form the oxygen deficient secondary combustion zone. The temperature within calciner 50 is preferably between about 1600° F. and about 2200° F. The remaining portion of hydrocarbon fuel which is mixed with the combustion products/calcined sorbent mixture comprises between about 70% to about 99% of the total amount of hydrocarbon fuel injected into combustion chamber 15 through sorbent inlet nozzle 43. To promote thorough mixing of the combustion air, first portion of hydrocarbon fuel and sorbent, calciner 50 is preferably of a cyclone type in which the combustion air, first portion of hydrocarbon fuel and sorbent are swirled within calciner 50 in the manner shown in FIG. 4.

In a process in accordance with this invention, combustible material is introduced through combustible material inlet 37 into combustion chamber 15 and onto drying grate portion 20 of the grate. The combustible material is further advanced, preferably by reciprocating motion and gravity over combustion grate portion 25 and burnout grate portion 30. Undergrate air is supplied beneath and the through drying grate portion 20, combustion grate portion 25 and burnout grate portion 30 for drying and combusting the combustible material. Ash products are removed from combustion chamber 15 through ash pit outlet 35 which is located downstream of burnout grate portion 30, within combustion chamber 15. A sorbent is calcined in calciner 50 in which a first portion of hydrocarbon fuel mixed with combustion air is combusted resulting in temperatures in a range of about 1600° F. to about 2200° F. and forming a product gas/calcined sorbent mixture. The combustion products/calcined sorbent is mixed with a remaining portion of hydrocarbon fuel and, optionally, flue gases recirculated from the boiler section of the furnace and injected into combustion chamber 15 through sorbent inlet nozzle 43, forming an oxygen deficient secondary combustion zone immediately downstream of the primary combustion zone formed by the combustion of the combustible material. In another embodiment, sorbent, preferably limestone or dolomite, is mixed with hydrocarbon fuel and, optionally, flue gases recirculated from the boiler section of the furnace, water, steam, air and/or industrial grade nitrogen and injected into combustion chamber 15 through sorbent inlet nozzle 43. In a preferred embodiment, the hydrocarbon fuel is natural gas. The majority of $SO_x$, HCl and FNS formed in the primary combustion zone are simultaneously reduced in the oxygen deficient secondary combustion zone. The mean residence time for the products of combustion within the reducing secondary combustion zone is preferably about 1 second to about 4 seconds. Vitiated air is ejected from above burnout grate portion 30 and is injected, optionally mixed with fresh air or industrial grade oxygen, into combustion chamber 15 through overfire air inlet 45, forming an oxidizing tertiary combustion zone downstream of the oxygen deficient secondary combustion zone. The mean residence time for the products of combustion within the oxidizing tertiary combustion zone is preferably about 1 second to about 5 seconds. Total $SO_x$ emissions in flue gases exiting furnace 10 are reduced from about 80% to about 95% and total HCl emissions are reduced from about 95% to about 99%. Such emission reductions are considerably greater than the emission reductions obtained by the known prior art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A combustion process for reducing at least nitrogen oxides, sulfur oxides and hydrogen chloride in a furnace, the process comprising the steps of:

(a) introducing a combustible material into a drying zone within a combustion chamber;

(b) supplying air to said drying zone for preheating, drying, and partially combusting said combustible material;

(c) advancing said combustible material to a combustion zone within said combustion chamber;

(d) supplying air to said combustion zone for further combusting said combustible material;

(e) advancing said combustible material to a burnout zone within said combustion chamber;

(f) supplying air to said burnout zone for final burnout of uncombusted portions of said combustible material;

(g) injecting one of a sorbent and a calcined sorbent, and a fuel into said combustion chamber above said combustible material to create an oxygen deficient secondary combustion zone;

(h) ejecting vitiated air from the burnout zone;

(i) injecting at least one of overfire air and said vitiated air into said combustion chamber above said oxygen deficient secondary combustion zone forming an oxidizing tertiary combustion zone for thorough mixing and final burnout of combustibles in combustion products of said combustible material; and (j) removing ash from said combustion chamber.

2. A process according to claim 1, wherein air, sorbent and a first portion of said fuel is introduced into a calciner forming a gas/calcined sorbent mixture.

3. A process according to claim 2, wherein said gas/calcined sorbent mixture and a remaining portion of said fuel is injected into said combustion chamber above said combustible material to create said oxygen deficient secondary combustion zone.

4. A process according to claim 3, wherein said gas/calcined sorbent mixture is mixed with said remaining portion of said fuel in said calciner prior to injection into said combustion chamber.

5. A process according to claim 1, wherein recirculated flue gases are injected into said oxygen deficient secondary combustion zone.

6. A process according to claim 1 wherein said fuel is natural gas.

7. A process according to claim 2, wherein said first portion of said fuel comprises between about 1% and about 30% of a total amount of said fuel injected into said combustion chamber.

8. A process according to claim 3, wherein said remaining portion of said fuel comprises between about 70% and about 99% of a total amount of said fuel injected into said combustion chamber.

9. A process according to claim 2, wherein said calciner is a cyclonic furnace.

10. A process according to claim 2, wherein said calciner is operated at a calciner temperature between about 1600° F. and about 2200° F.

11. A process according to claim 1, wherein said oxygen deficient secondary combustion zone is maintained at an oxygen deficient secondary combustion zone temperature between about 1600° F. and about 2400° F. and has an oxygen concentration equivalent to about 0.6 to about 1.2 of a stoichiometric requirement for complete combustion of said combustible in said combustion products in said oxygen deficient secondary combustion zone.

12. A process according to claim 1, wherein a primary mean residence time for primary combustion products from said primary combustion zone within said oxygen deficient secondary combustion zone is between about one second and about four seconds.

13. A process according to claim 1, wherein a secondary mean residence time for secondary combustion products from said oxygen deficient secondary combustion zone is between about one second and about five seconds.

14. A process according to claim 1, wherein at least one of said overfire air and said vitiated air injected into said oxidizing tertiary combustion zone provides between about 5% and about 50% excess air within said oxidizing tertiary combustion zone.

15. A process according to claim 1, wherein said oxidizing tertiary combustion zone is maintained at an oxidizing tertiary combustion zone temperature of between about 1600° F. and about 2400° F.

16. A process according to claim 1, wherein said combustible material comprises one of municipal solid wastes, refuse derived fuels and mixtures thereof.

17. A process according to claim 1, wherein said sorbent is one of limestone and dolomite.

18. A process according to claim 3, wherein said fuel is natural gas.

19. A process according to claim 18, wherein said first portion of said fuel comprises between about 1% and about 30% of a total amount of said fuel injected into said combustion chamber.

20. A process according to claim 19, wherein said remaining portion of said fuel comprises between about 70% and about 99% of said total amount of said fuel injected into said combustion chamber.

21. A process according to claim 20, wherein said calciner is a cyclonic furnace.

22. A process according to claim 21, wherein said calciner is operated at a calciner temperature between about 1600° F. and about 2200° F.

23. A process according to claim 22, wherein said oxygen deficient secondary combustion zone is maintained at an oxygen deficient secondary combustion zone temperature between about 1600° F. and about 2400° F. and has an oxygen concentration equivalent to about 0.6 to about 1.2 of a stoichiometric requirement for complete combustion of said combustibles in said combustion products in said oxygen deficient secondary combustion zone.

24. A process according to claim 23, wherein a primary mean residence time for primary combustion products from said primary combustion zone within said oxygen deficient secondary combustion zone is between about one second and about four seconds.

25. A process according to claim 24, wherein a secondary mean residence time for secondary combustion products from said oxygen deficient secondary combustion zone within said oxidizing tertiary combustion zone is between about one second and about five seconds.

26. A process according to claim 25, wherein at least one of said overfire air and said vitiated air injected into said oxidizing tertiary combustion zone provides between about 5% and about 50% excess air within said oxidizing tertiary combustion zone.

27. A process according to claim 26, wherein said oxidizing tertiary combustion zone is maintained at an oxidizing tertiary combustion zone temperature of between about 1600° F. and about 2400° F.

28. A process according to claim 27, wherein said combustible material comprises one of municipal solid wastes, refuse derived fuels and mixtures thereof.

29. A process according to claim 28, wherein said sorbent is one of limestone and dolomite.

* * * * *